US008087841B2

(12) United States Patent
Liu

(10) Patent No.: US 8,087,841 B2
(45) Date of Patent: Jan. 3, 2012

(54) RETRACTABLE PEN WITH RETRACTION-LINKING DEVICE FOR EXTENDING PEN-BODY

(75) Inventor: Yu-Yin Liu, Taipei (TW)

(73) Assignee: Spark Gold Co., Taipei (TW)

( * ) Notice: Subject to any disclaimer, the term of this patent is extended or adjusted under 35 U.S.C. 154(b) by 356 days.

(21) Appl. No.: 12/395,726

(22) Filed: Mar. 2, 2009

(65) Prior Publication Data

US 2010/0129131 A1 May 27, 2010

(30) Foreign Application Priority Data

Nov. 12, 2008 (TW) ..... 97145770 A

(51) Int. Cl.
*B43K 5/16* (2006.01)

(52) U.S. Cl. ..... 401/112; 401/109; 401/99

(58) Field of Classification Search ..... 401/109–112, 401/194

See application file for complete search history.

(56) References Cited

U.S. PATENT DOCUMENTS 4,381,158 A * 4/1983 Garganese ..... 401/111
4,533,272 A * 8/1985 Sakai ..... 401/107
4,601,599 A * 7/1986 Katoh ..... 401/99
4,991,988 A * 2/1991 Snell et al. ..... 401/111
5,413,428 A * 5/1995 Kageyama ..... 401/110
6,273,627 B1 * 8/2001 Mittersinker et al. ..... 401/117
6,276,855 B1 * 8/2001 Hsien ..... 401/114
6,280,110 B2 * 8/2001 Lin ..... 401/106
6,382,860 B1 * 5/2002 Kim ..... 401/104
6,474,889 B2 * 11/2002 Kato ..... 401/117
6,554,518 B1 * 4/2003 Pei ..... 401/112
6,752,557 B1 * 6/2004 Hsieh ..... 401/117
6,832,868 B2 * 12/2004 Hertwig et al. ..... 401/117
7,350,996 B2 * 4/2008 Bielecki et al. ..... 401/108
7,452,149 B2 * 11/2008 Saito ..... 401/116
2006/0239761 A1 * 10/2006 Cetera ..... 401/258
2008/0095568 A1 * 4/2008 Hsien ..... 401/115

* cited by examiner

*Primary Examiner* — David J. Walczak
*Assistant Examiner* — Jennifer C Chiang

(57) ABSTRACT

A retractable pen includes an improved triggering device (i.e., an actuating means), which is easy for manufacturing and user-friendly. The retractable pen has a pen-body having two pen-tubes, a pen-cartridge within the pen-body, and an actuating means. The actuating means not only triggers the movement of pen-cartridge (slidable protrusion/retraction of the pen-cartridge) but also, at the meantime, triggers length-change of pen-body (slidable movement between the two pen-tubes).

7 Claims, 6 Drawing Sheets

RETRACTABLE PEN WITH RETRACTION-LINKING DEVICE FOR EXTENDING PEN-BODY

This application claims the priority of Taiwan patent application No. 097145770 filed on Nov. 12, 2008.

BACKGROUND OF THE INVENTION (1). Field of Invention

This invention relates to a pen; and more particularly relates to a pen with a retractable pen-cartridge (a retractable pen) that can elongate the length of its pen-body and project out the refill out of the pen point when the pressing part is pressed and provide sufficient length for holding the pen while writing, and shorten the length of the pen when the pressing part is pressed again to restore the refill in the pen point.

(2). Description of Related Art

Conventional retractable pens use either pushing or rotation for retracting/protruding its pen-cartridge and these retractable pens are normally designed to be long enough for easy writing. Their pen-body's length will provide difficulties to carry inside a small space (such as a packet, a wallet, or a purse). It is desirable to provide a retractable pen that has length adjustable capability—not only long enough for suitable handling the writing, but also short enough for easy carry.

Various devices have been disclosed to achieve this desirability. Among them, U.S. Pat. No. 6,832,868 (Dec. 21, 2004) to Hertwig and Nestlen describes a retractable pen whose triggering-device actuates the protrusion of its pen-cartridge, and, at the meantime, the same device actuates the lengthening its length; and vice versa by the same device after second another actuating step. However, the structure of the pen is complicate, and that of the triggering-device is mechanistically fragile. Accordingly, it is not only difficult to assemble/disassemble but also hard to perform routine maintenance by end users. It should thereby be appreciated to provide an improved triggering device for overcoming the above-mentioned shortcomings.

SUMMARY OF THE INVENTION

The present invention is drawn to a retractable pen that has an improved triggering device (i.e., an actuating means), which is easy for manufacturing and user-friendly. The retractable pen has a pen-body comprising: a pen-body that has two pen-tubes, a pen-cartridge within the pen-body, and an actuating means that not only triggers the movement of pen-cartridge (slidable protrusion /retraction of the pen-cartridge) but also, at the meantime, triggers length-change of pen-body (slidable movement between the two pen-tubes).

Several objects of the present invention are as follows: (1) to provide a retractable pen that has a actuating means (which not only actuates pen-cartridge's retraction and pen-body's shortening by one simple actuating step, thus the pen is easy to carry in a small space; but also actuates pen-cartridge's protrusion and pen-body's extending by another step, thus the pen is long enough for writing with the protruded pen-cartridge) and a simple-constructed pen-body; (2) to provide the actuating means that is mechanically simple, and simply constructed, thus the manufacture expense is reduced; (3) to provide such actuating means that, during routine maintenance, is easily assembled and disassembled by end users, thus user friendly is enhanced. Still further objects and advantages of present invention will become apparent from a consideration of the drawings and ensuing description.

REFERENCE NUMERALS IN DRAWINGS

Figure 1A:
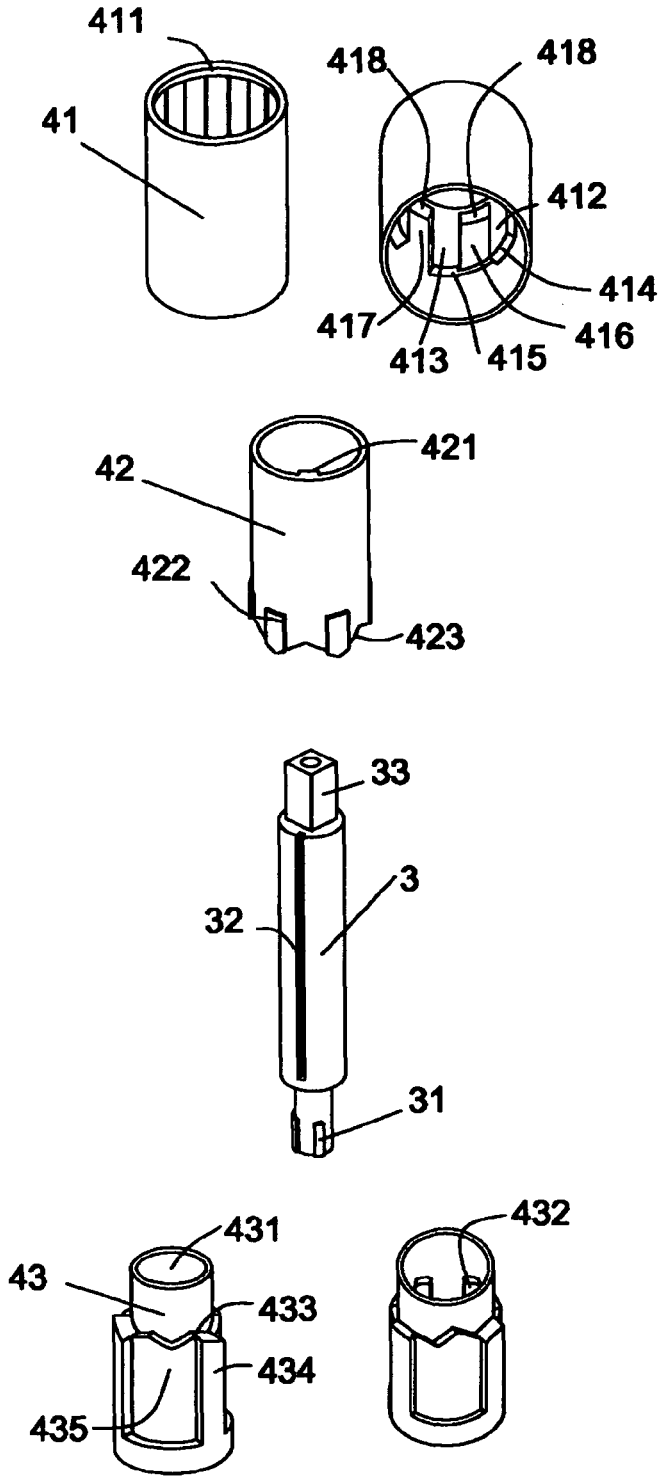
FIG. 1A & 1B are a perspective view and a cross-sectional view of one embodiment of the actuating mean of the present invention.

Reference numerals used herein are as follows:

| | |
|---|---|
| 1 | Lower Pen-Tube |
| 11 | First Opening |
| 111 | First Pattern |
| 12 | Pen-Point |
| 13 | Stop-Ring |
| 2 | Upper Pen-Tube Unit |
| 21 | Pressing Part |
| 211 | First-Joint |
| 22 | Inner-Sleeve |
| 221 | Second Pattern |
| 23 | Pen-Clip |
| 24 | Upper Pen-Tube |
| 241 | Window |
| 25 | Bushing Ring |
| 3 | Retractable-Core-Rod |
| 31 | Lug |
| 32 | Slide-Groove |
| 33 | Second-Joint |
| 4 | Jump key Unit |
| 41 | Stationary-Cam-Sleeve |
| 411 | Stop-Edge |
| 412 | First-Rib |
| 413 | Second-Rib |
| 414 | First-Rib-Slant |
| 415 | Second-Rib-Slant |
| 416 | First-Cam-Groove |
| 417 | Second-Cam-Groove |
| 418 | Stop-Limit |
| 42 | Plunger |
| 421 | Guide-Block |
| 422 | Flat Rib |
| 423 | Upper-Toothed Part |
| 43 | Rotating Cam |
| 431 | Channel |
| 432 | Stop-Block |
| 433 | Lower-Toothed Part |
| 434 | Key-Rib |
| 435 | Cam-Groove |
| 436 | Clinch-Joint |
| 44 | First-Spring |
| 5 | Pen-Refill Unit |
| 51 | Pen-Refill Tube |
| 511 | First-Ring-Pad |
| 512 | Sleeve-Joint |
| 52 | Second-Spring |
| 53 | Pen-Refill Sleeve |
| 531 | Second-Opening |
| 532 | Second-Ring-Pad |
| 54 | Pen-Cartridge |
| 55 | Third-Spring |

DETAILED DESCRIPTION

The present invention provides a retractable pen that has a pen-body comprising two pen-tubes, and a device for linking the capability of protrusion/retraction the pen-cartridge with the ability of extending/shortening its pen-body. Such device is termed as an actuation means herein. Particularly, the actuating means links the protrusion of its pen-cartridge with the extension of its pen-body's length by a slidable movement between the two pen-tubes.

Figure 3A:
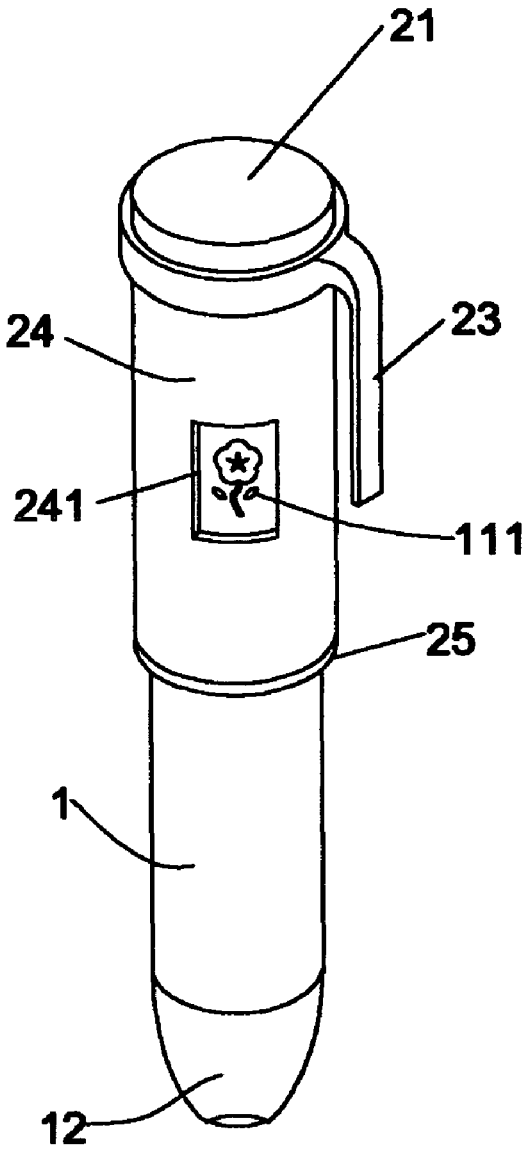
FIG. 3A & 3B are two plan views of two embodiments of the present invention at resting stage (where pen-cartridge is retracted within its pen-body, and the pen-body is shortened for easy carrying inside small area).
Figure 3B:
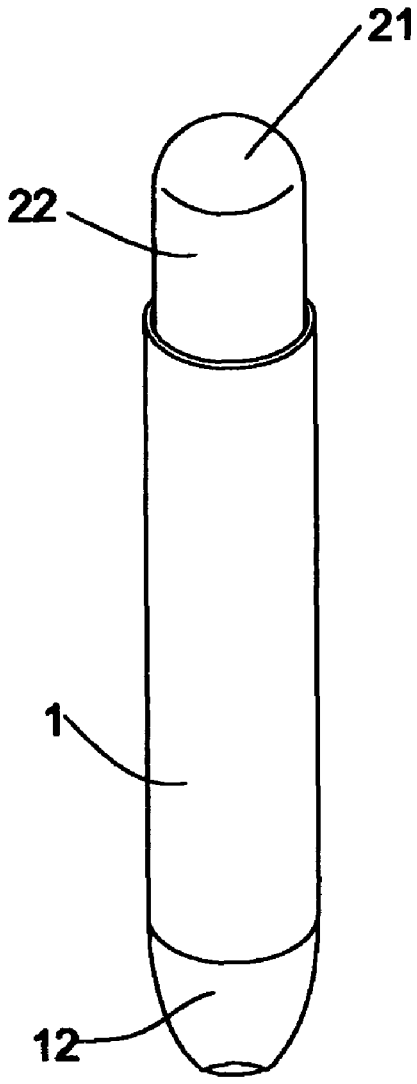
Figure 4:
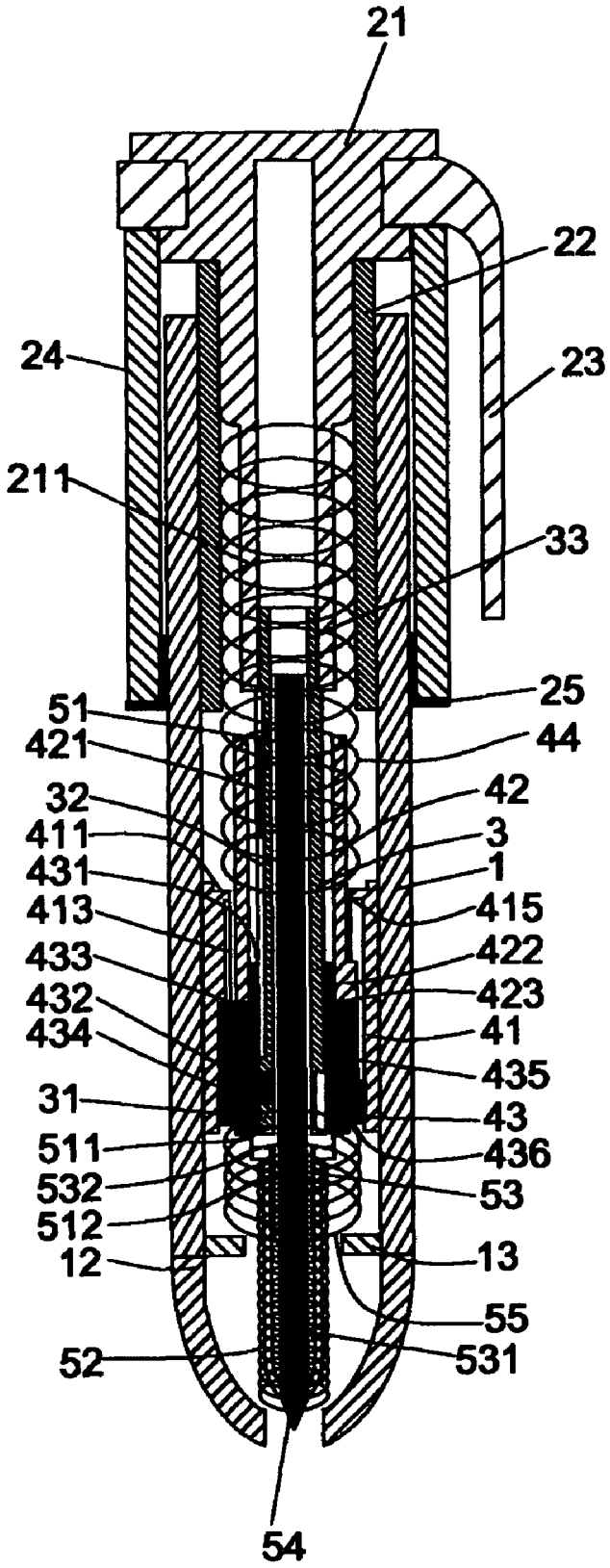
FIG. 4 is a cross-sectional view of FIG. 3A.

Also used herein: Pen means any writing device/implement; Spring means any elastic element; Resting stage means the stage where pen cartridge is retracted within its pen-body and the pen-body is shortened (FIGS. 3A-3B & 4); Working stage means the stage where pen-cartridge is protruded outside its pen-body (FIGS. 5A-5C & 6).

A. The Preferred Embodiment of the Present Invention

Figure 1B:
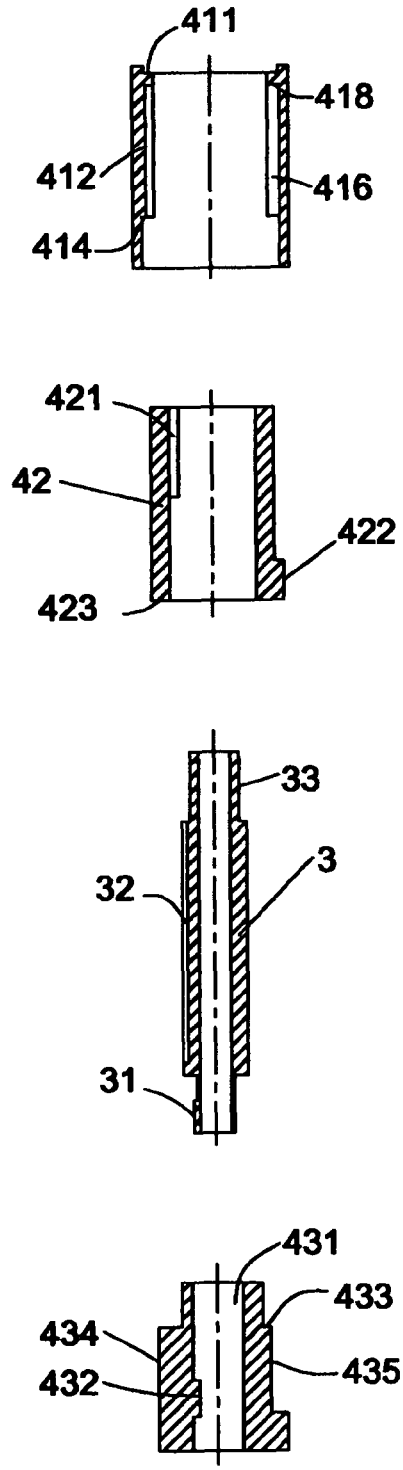

The pen of the present invention comprises: (1) a pen body; (2) a pen-refill unit 5, which contains a pen-cartridge 54 inside the pen body; and (3) an actuating means, which has a retractable-core-rod 3 and a jump key unit 4 (FIG. 1A & 1B).

(1) Pen Body

Pen body has: (a) a lower pen-tube 1 and (b) an upper pen-tube 2 being slidably mounted to lower pen-tube 1 either inside (FIGS. 3A) or outside (FIGS. 3B).

a. Lower Pen-Tube 1

Figure 2:
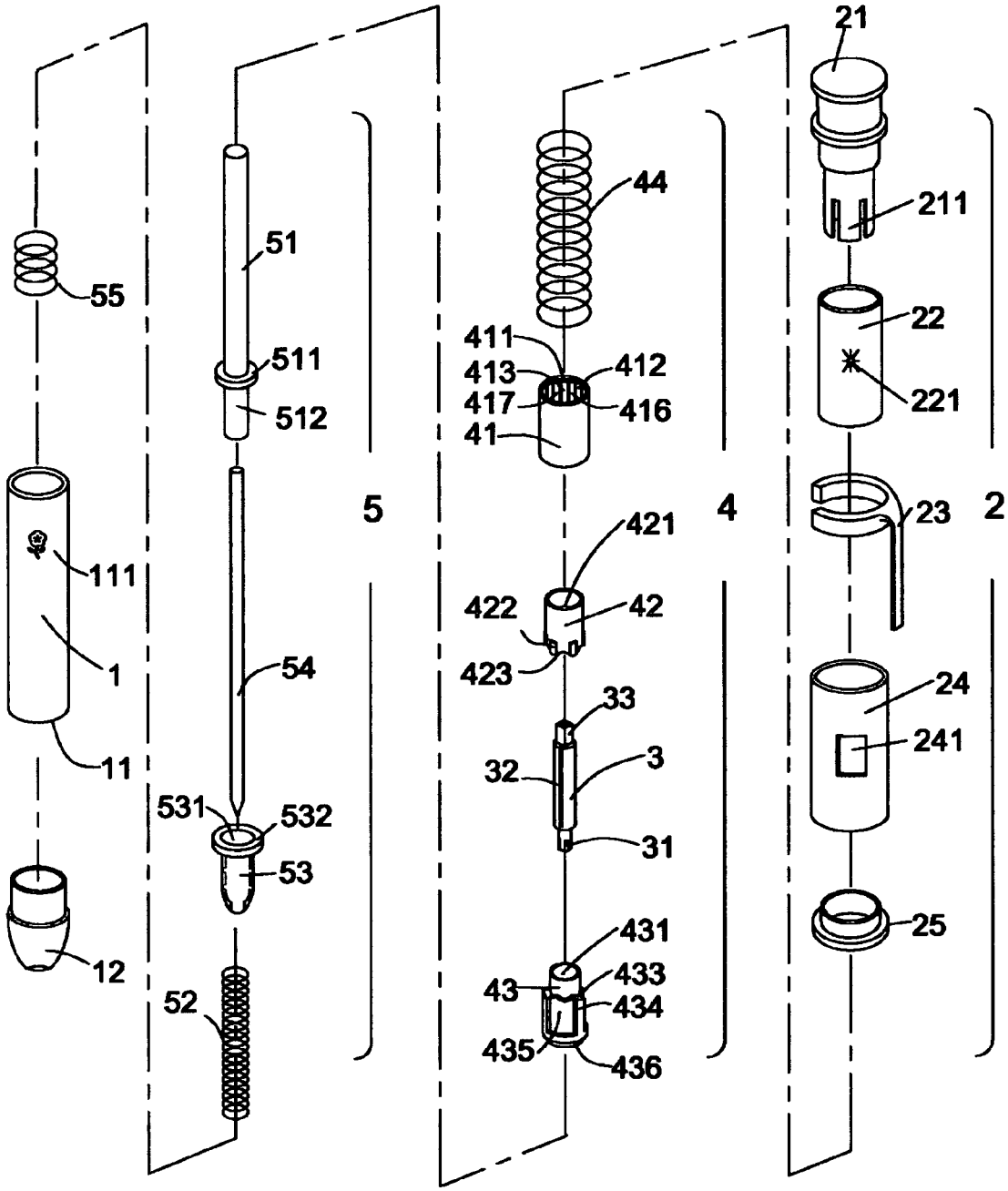
FIG. 2 is an isometric-exploded view of one embodiment of the present invention.
Figure 5A:
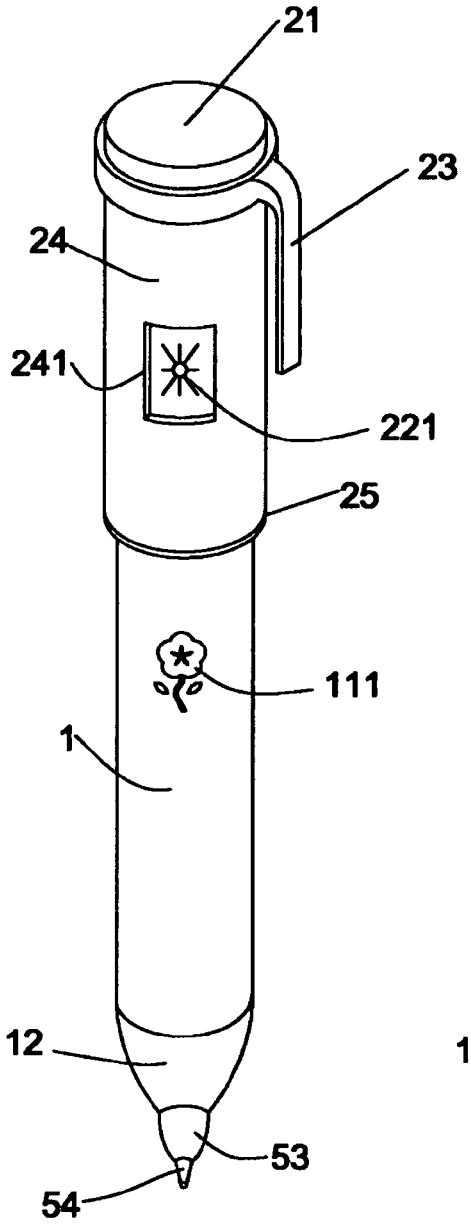
FIGS. 5A, 5B & 5C are plan views of three embodiments of the present invention at working stage (where pen-cartridge is protruded outside its pen-body for writing, and the pen-body is elongated for easy handing the writing).
Figure 5B:
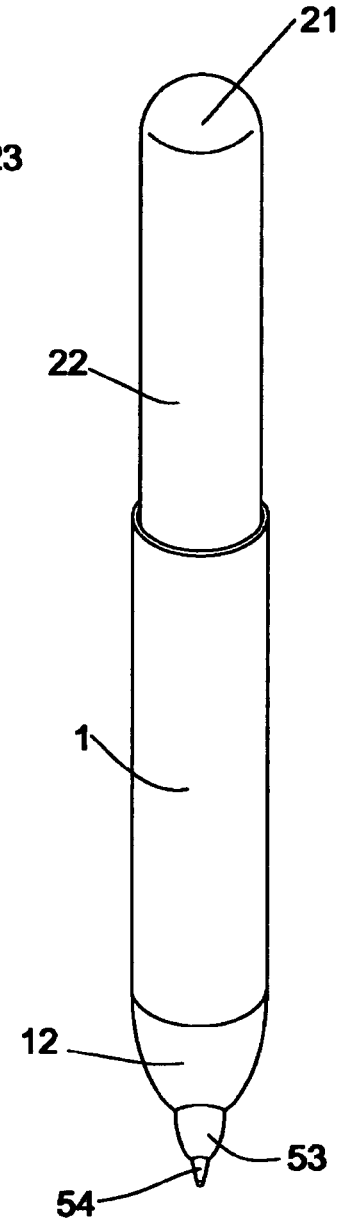
Figure 5C:
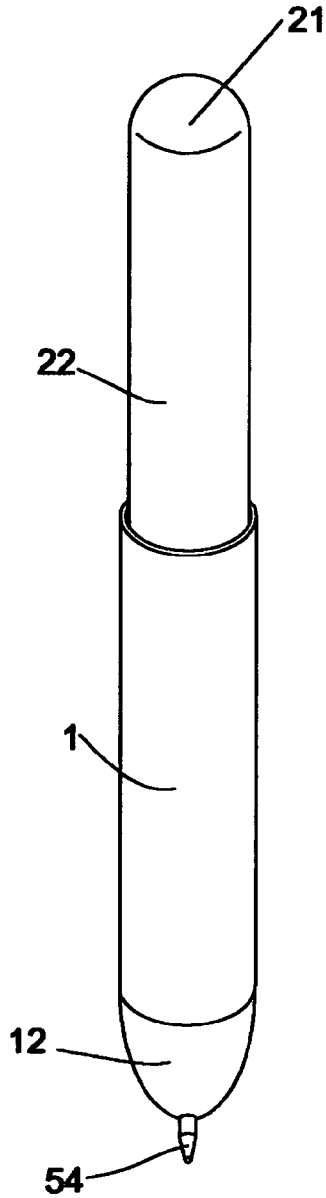
Figure 6:
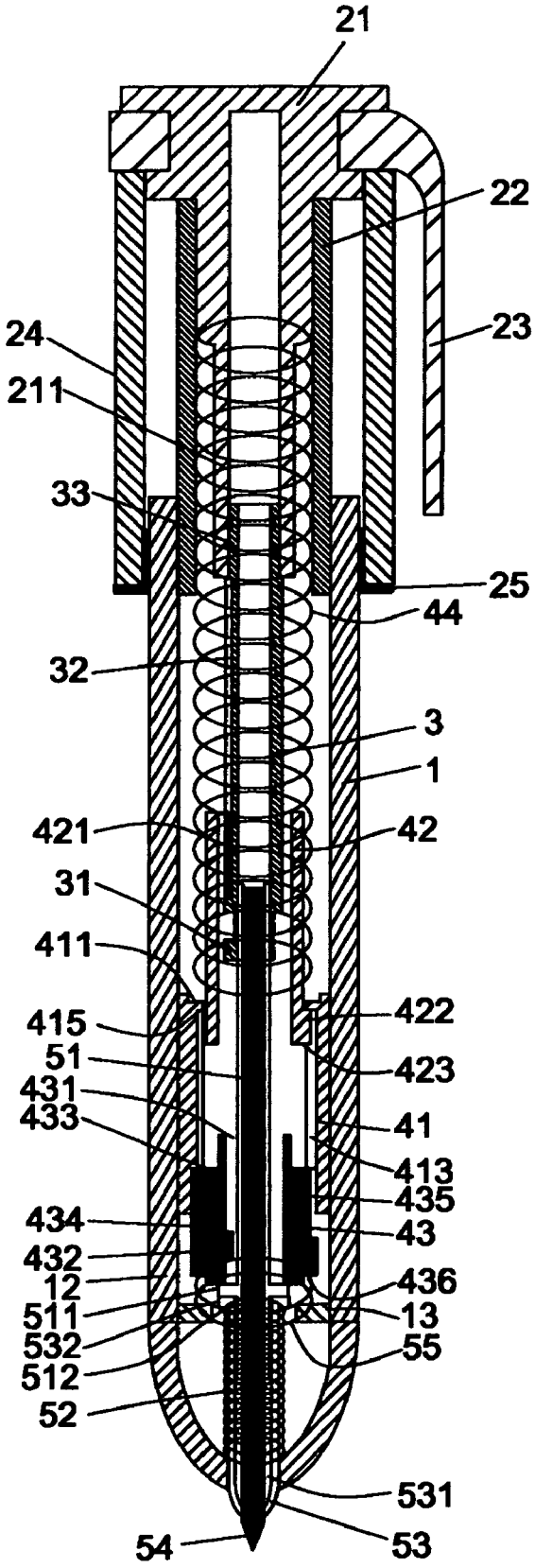
FIG. 6 is a cross-sectional view of FIG. 5A.

Forming a pen-point 12 with a passage at the bottom for allowing the protrusion of pen-cartridge 54 (FIGS. 5A-5C). Within lower pen-tube 1 and above pen-point 12, a stop-ring 13 is disposed (FIGS. 4 & 6, as well as FIG. 2).

Stop-ring 13 delimits concentrically an first opening 11. Instead of an integral part, the pen-point 12 can be a separated part, attached to lower pen-tube 1 (FIG. 2) for allowing easy replacement of pen-cartridge 54.

b. Upper Pen-Tube Unit 2

Upper pen-tube Unit 2 is movably and slidably mounted with lower pen-tube 1 either outside or inside (FIG. 3 & 5). It comprises an upper pen-tube 24, an inner-sleeve 22 situated within upper pen-tube 24, and a pressing part 21 at the top.

Pressing part 21 has, at the bottom, a first-joint 211(FIG. 2) whose bottom end is contoured as a female for mating with the male of actuating means (i.e., second-joint 33). The diameter of first-joint 211 is small than that of pressing part 21, whereby a gap-portion is formed underneath pressing part 21. This gap-portion serves as a bias for one elastic component of actuating means (i.e., first-spring 44).

As a ramification of the preferred embodiment, upper pen-tube 2 may further has a bushing ring 25 below upper pen-tube 24 for reducing the undesirable abrasion, caused by the slidable movement between lower pen-tube 1 and upper pen-tube 2, as well as a pen-clip 23 attached for easy carrying the pen (detailed in RAMIFICATION infra).

(2) Pen-Refill Unit 5

Pen-refill unit 5 is coaxially disposed around the center of the pen body (FIGS. 4 & 6). The pen-refill unit 5 is disposed inside a retractable-core-rod 3, that is provided with an first-ring-pad 511. One side of the first-ring-pad 511 is in close contact with a rotating cam 43, and the other side of the first-ring-pad 511 is supported by a second-spring 52. It comprises: (1) a pen-cartridge 54, coaxially situated around the center of the pen body; (2) a pen-refill tube 51, coaxially surrounded pen-cartridge 54, that has, on the outer surface, a first-ring-pad 511 that delimits a sleeve-joint 512 at the bottom; (3) a second-spring 52, disposed below pen-refill tube 51, that pushes against first-ring-pad 511 upward of pen-refill tube 51 and against one part of pen-point 12 downward; and (4) a third-spring 55, disposed below rotation cam 43, that one end to lean against stop-ring 13 and against one part of under actuating means (i.e., clinch-joint 436). Both sides of first-ring-pad 511 of the pen-refill unit 5 respectively leant against the rotating cam 43 and the second-spring 52. Optionally, pen-refill unit 5 has a pen-refill sleeve 53 positioned pen-refill tube 51 underneath (detailed in RAMINFICATION infra).

(3) Actuating Means

Actuating means is an essential part of the present invention. It actuates not only the retraction/protrusion of pen-cartridge 54 but also the lengthening/shortening of the pen body. It has (a) a retractable-core-rod 3 and (b) a jump key unit 4. (FIGS. 1A-1B & 2)

a. Retractable-Core-Rod 3

Retractable-core-rod 3 comprises at least one slide-groove 32 formed on an external side thereof, and at least one lug 31 is formed on a periphery of one end thereof and a second-joint 33 formed on another end. The retractable-core-rod 3 is movably disposed in the jump key unit 4 to move simultaneously with the upper pen-tube unit 2 in conjunction with the jump key unit 4. The second-joint 33 is disposed at one end of the retractable-core-rod 3 and securely jointed to first-joint 211 by various jointing methods such as head-hinge, embedding, or screw-joint). The retractable-core-rod 3 comprises at least one wedge-like block (i.e., lug 31) at one end for mating to a wedge-like protruded counterpart of Jump Key Unit 4 (i.e., stop-block 432). The slide-groove 32 is disposed between lug 31 and second-joint 33 ; the retractable-core-rod 3 comprises at least one groove (i.e., slide-groove 32) on exterior surface thereof that run upward to second-joint 33 and downward before lug 31, that slides within the protrusion-counterpart of jump key unit 4 (i.e., guide-block 421).

b. Jump Key Unit 4

Jump key unit 4 has: (1) an stationary-cam-sleeve 41 fixed inside the lower pen-tube 1, (2) a first-spring 44, (3) an rotating cam 43, and (4) an plunger 42 operates in conjunction with the retractable-core-rod 3 and the stationary-cam-sleeve 41 (FIG. 2)

[1] Stationary-Cam-Sleeve 41

Stationary-cam-sleeve 41 has: (1) a stop-edge 411, (2) a second-rib 413, (3) a first-rib 412, (4) a first-cam-groove 416 that shallower than second-cam-groove 417, (5) a second-cam-groove 417, (6) a stop-limit 418, and (7) a slant means that has first-rib-slant 414 and a second-rib-slant 415. (FIGS. 1A & 1B)

Stop edge 411 is a ring-like structure at one edge (FIG. 1A). At predetermined positions, stop-edge 411 extends downward in a pair-fashion, preferably equally spaced, and with different thickness, formed on one peripheral end of the stationary cam sleeve 41, and a plurality of ribs and grooves are formed on the inner edge of the stationary cam sleeve 41.

While essentially no downward extension makes deep groove (termed as a second-cam-groove 417), thin downward extension makes shallow groove (termed as a first-cam-groove 416). Accordingly, first-cam-groove 416 is shallower than second-cam-groove 417.

A pair of cam-grooves 416 and 417 is sandwiched by a pair of ridges, which are formed when stop-edge 411 extends downward in a thick fashion, preferably with the same thickness as stop-edge 411. After passing cam-grooves 416 and 417, the thick downward extension of stop-edge 411 bevels sideward forming a pair of corresponding bevel ends. Depending on the relative position to first-cam-groove 416, a pair of ridges (with their corresponding bevel ends) is termed differently as: a first-rib 412, a second-rib 413, and their corresponding bevels end as a first-rib-slant 414 and a second-rib-slant 415. Because the thin extension of first-cam-groove 416 terminates at the bevel end of the ridges, not only it is shallower than second-cam-groove 417, but also it is shorter than the ridges.

[2] First-Spring 44

First-spring 44 component disposed on the retractable-core-rod 3 with both ends thereof respectively head hinged against the upper pen tube unit 2 and the stationary cam sleeve 41. It is coaxially located above stop-edge 411. (FIGS. 2, 4 & 6) It not only held the stop-edge 411 but also passing first-joint 211 and pressing part 21.

[3] Rotating Cam 43

Rotating cam 43 has a channel 431, a stop-block 432, a lower-toothed part 433, a key-rib 434, a cam-groove 435, and a clinch-joint 436. (FIG. 1A, bottom row)

Channel 431 is disposed around the center of rotating cam 43. At least one stop-block 432 is placed within channel 431 for serving as a male (i.e., tenon-like protrusion) who interlocks the lug 31, so that jump part unit 4 interlocks retractable-core-rod 3 in a dovetail-like fashion.

The top of the rotating cam 43 is circumferentially formed with lower-toothed part 433. The lower-toothed part 433 operate in conjunction with and engage with upper-toothed part 423 circumferentially formed in the bottom of the plunger 42. A plurality of key-rib 434 and cam-groove 435 are peripherally formed across the surface of the rotating cam 43. The key-rib 434 is movable along a second-cam-groove 417 of the stationary-cam-sleeve 41 or abuts against a second-rib-slant 415 of the stationary-cam-sleeve 41. A first-rib 412 and a second-rib 413 of the stationary-cam-sleeve 41 can slide along the cam-groove 435 of the rotating cam 43; then the serrated internal part is further extended outward in a pair-fashion, forming a least one pair of ridges (termed as key-rib 434), spaced by at least one pair of cam-grooves 435, and a serrated lower-toothed part 433 on the top thereof.

[4] Plunger 42

Plunger 42 comprises a plurality of flat rib 422 disposed on an exterior edge thereof, and least one guide-block 421, and an upper toothed part 423 on one end thereof (a plurality 42 of flat ribs 422 are disposed on the peripheral edge of one end of the plunger 42, and an upper toothed part 433 is disposed on the peripheral edge of one end of the plunger 42.); that is disposed not only concentrically around retractable-core-rod 3 (FIGS. 4 & 6) but also above rotating cam 43 (FIG. 2). As illustrated in FIGS. 1A & 1B, it has: (1) a guide-block 421, disposed on the top portion of the inner surface of the hollow-tube; (2) a plurality of flat rib 422; and (3) an upper toothed part 423 disposed on the bottom surface.

The plunger 42 correspondingly moves with the joint of the upper pen tube unit 2, at least is formed on a guide-block 421 sliding in the slide-groove 32 of the retractable-core-rod 3, and at least one stop-block 432 inside the rotating cam 43 allowing the lug 31 to move and stopped.

When third-spring 55 pushes rotating cam 43 upward, plunger 42 meets rotating cam 43. When rotating cam 43 meets plunger 42, upper-toothed part 423 mates lower-toothed part 433 for avoiding rotational displacement between plunger 42 and rotating cam 43. A slide-groove 32 of the retractable-core-rod 3 and a guide-block 421 of the plunger 42 allow the retractable-core-rod 3 to move within a jump key unit 4 comprised by stationary-cam-sleeve 41, plunger 42, and rotating-cam 43. The lug 31 of the retractable-core-rod 3 and the stop-block 432 of the rotating-cam 43 allow the retractable-core-rod 3 to move within the jump key unit 4.

B. Ramification of the Preferred Embodiment

The above-mentioned embodiments are the preferred embodiments and some of the best modes of carrying out the invention. They are intended to illustrate but not to limit the present invention. It will be apparent to one skilled in the art that various substitutions and modifications may be made to the invention disclosed herein without departing form the scope and the spirit of the invention. For example:

Pen-point 12 may be an integral embodiment to the present invention, instead of a separated element. A pen-chip 23 may attach to the retractable pen of the present invention for easy carry. As illustrated in (FIGS. 2, 3A & 5A), pen-clip 23 is attached to the pressing part 21 of the upper pen-tube 2.

Further, upper pen-tube 2 may has a bushing ring 25 below upper pen-tube 24 for reducing the undesirable abrasion, caused by the slidable movement between lower pen-tube 1 and upper pen-tube 2, as well as a pen-clip 23 attached for easy carrying the pen (detailed in RAMIFICATION). Pen-refill sleeve 53 has (1) a second-opening 531 in the center, and (2) a second-ring-pad 532 fringed around the upper end (illustrated in FIGS. 2, 5A, 5B & 6). When pen-refill tube 51 is inserted into second-opening 531, first-ring-pad 511 will touch second-ring-pad 532, whereby sleeve-joint 512 is disposed within pen-refill sleeve 53. In this ramification, second-ring-pad 532 is situated under the first-ring-pad 511 and is pushed against by the upper end of second-spring 52. More preferably, pen-refill sleeve 53 is tempered downward, whereby a tempered end is formed. The tempered end is contoured to match the shape of protruded end of pen cartridge 54 for aesthetical appeal and for easy writing (FIGS. 5A & 5B).

For esthetic appearance, lower pen-tube 1 can has a first pattern 111 on the surface (FIGS. 2, 3A & 3B). The present invention can have means for changing aesthetic appearance. Here, upper pen-tube 2 has both a second pattern 221 situated on the outer surface of inner-sleeve 22 and a window 241 situated at a predetermined position on the surface of upper pen-tube 24. Depending on the relatively geological location to window 241, first pattern 111 can be seen through window 241 either when pen body is retracted (at the rest position, FIG. 3A), second pattern 221 can be seen through window 241 either when pen body is extended (at working stage, FIG. 5A).

These and many other variations are intended to be within the scope of the present invention. Accordingly, the scope of the invention should be determined by the claims and their legal equivalents, rather than the embodiments given.

C. The Best Modes of Carrying Out the Invention

The momentum of the present invention is provided by three elastic elements: first-spring 44, second-spring 52, and third-spring 55 (FIG. 2). While elastic elements expend, they push both sides (upward and downward). The springs used in the present invention, however, are biased onto one integral component of the pen. Accordingly, they push unidirectionally: (a) First-spring 44, biased on first-joint 211, on its stop-edge 411; (b) Second-spring 52, biased on pen-point 12, pushes pen-refill tube 51 upward, on its first-ring-pad 511; (c) Third-spring 55, disposed on one end of the lower pen tube 1 with both ends thereof respectively head hinged against the rotating cam 43 and the stop-ring 13, biased on stop-ring 13, pushes rotating cam 43 upward, on its clinch-joint 436. Thereby keeping the rotating cam 43 head hinged by the third-spring 55, and thereby maintaining its correct linked motion position within the lower pen tube 1.

The mechanical joints of the preferred embodiment are also detailed supra. Comparing working stage (FIG. 6) with resting stage (FIG. 4), one should notice that mechanical linkage between retractable-core-rod 3 and jump key unit 4 varies: While they separate, resulting to the elongated pen-body at working stage (FIG. 6); while they interlock in a dovetail-like fashion lug 31 mates with stop-block 432, resulting to the shortened pen-body at the resting stage (FIG. 4).

The locking/unlocking is controlled a cam (wheeling device) that can be triggered by either a simple rotation or a simple pressing (for illustrative purpose, the preferred embodiment uses the pressing). The functionality of the cam is included in the actuating means of the presenting invention. Not only the actuating mean locks/unlocks the mating between lug 31 and stop-block 432, but also it changes the pen-body length (summarized below):

First, the unique configuration of jump key unit 4, plunger 42, and rotating cam 43: Variation of thickness of thin parts of plunger 42 (flat rib 422) allows then sliding within and along the shallow groove (first-cam-groove 426) and the deep groove (second-cam-groove 417) of stationary-cam-sleeve 41, the protruded parts of rotating cam 43 (key-rib 434) allows then sliding within and along the deep groove of stationary-cam-sleeve 41 (second-cam-groove 417). Accordingly, one elongation of the pen-body is be archived.

Second, the upward movement of retractable-core-rod 3, which is secularly connected to upper pen-tube 2: When retractable-core-rod 3 is unlocked from the joint with jump key unit 4, two compressed springs (second-spring 52 & third-spring 55) relax. The combined elasticity of the two compressed springs overcomes the elasticity of the spring above (first-spring 44) and pushes upward retractable-core-rod 3 moves upward. The upward movement of retractable-core-rod 3 also moves its conjunctive upper pen-tube 2 upward. The upward movement of upper pen-tube 2, thus, slides along the lower pen-tube 1 results in another elongation of the pen-body. One skilled in the art will notice that the length of retractable-core-rod 3 can be in any predetermined, thereby the body length of the pen in the present invention can be configured in any predetermined length, delimited by the length of retractable-core-rod 3. This is another distinctive feature of the present invention.

The mode of operation is detailed further below:

Staring from the resting stage (FIG. 4), here lug 31 mates to stop-block 432 by pressing 21, which is securely attached to the retractable-core-rod 3 by a strong mechanical joint between first-joint 211 and second-joint 33. The mating (interlocking) compresses first-spring 44 from its more relaxed state to more compressed state, but relaxes both compressed springs (second-spring 52 and third-spring 55) from their more compressed state to their more relaxed state so that both springs regain their elasticity. While third-spring 55 pushes rotating cam 43 upward on its clinch-joint 436, second-spring 52 pushes pen-refill tube 51 upward on its first-ring-pad 511. Because pen-cartridge 54 is situated coaxially within pen-refill tube 51, pen-cartridge 54 is retracted within the pen-body. At the resting stage, user can change pen-cartridge 54 simply by removing its pen-point 12.

When users want to write (changing from resting stage to working stage), they simply push pressing part 21 again. The second push unlocking the mechanical joint between lug 31 and stop-block 431. The unlocking relaxes the first-spring 44 from the more compressed to more relaxed state, but compresses both second-spring 52 and third-spring 55 from their more relaxed state to more compressed state. The more relaxed second-spring 52 and third-spring 55 regain their elasticity. While third-spring 55 pushes rotating cam 43 onto its clinch-joint 436 upward, second-spring 52 pushed pen-refill tube 51 upward on its first-ring-pad 511, whereby the pen-body's is elongated and pen-cartridge 54 is protruded outside the pen-body (FIG. 6) in the manner summarized as follows:

For writing, the user may:

(1) Directly press on the end of upper pen-tube 2 to cause upper pen-tube 2 to move downward conjunctively with first-joint 211 and retractable-core-rod 3 toward rotating cam 43. The movement is slidable and guided by plunger 42 through the mating between female (slide-groove 32 of retractable-core-rod 3) and male (guide-block 421 of plunger 42), allowing slide-groove 32 of to slide through, such that first-joint 211 of upper pen-tube 2 pushes plunger 42.

(2) In the meantime, flat rib 422 of plunger 42 moves downward in first-cam-groove 416 and second-cam-groove 417 of stationary-cam-sleeve 41, and cam-groove 435 of the rotating cam 43 slides upward on first-rib 412 and second-rib 413 of the stationary-cam-sleeve 41, thus enabling plunger 42 to use the slant structure of the upper-toothed part 423 on the edge to push lower-toothed part 433 of rotating cam 43 to rotate the rotating cam 43, forcing key-rib 434 of the rotating cam 43 to separate from second-cam-groove 417 of stationary-cam-sleeve 41, thereby head hinging against second-rib 413 and second-rib-slant 415 at the bottom end of first-cam-groove 416, using one end of the first-rib 412 as the motion limitation.

(3) Meanwhile, cam-groove 435 of rotating cam 43 separate from first-rib 412 and second-rib 413 of stationary-cam-sleeve 41, and as rotating cam 43 rotates, it causes stop-block 432 of rotating cam 43 to leave from lug 31 of retractable-core-rod 3, thereby allowing lug 31 of retractable-core-rod 3 to slide in channel 431 of rotating cam 43, enabling the release of first-spring 44 to push upper pen-tube 2 upward, rotating cam 43 moving downward accordingly, making pen-refill sleeve 53 on one end of pen-refill unit 5 to protrude pen-point 12 and simultaneously compressing second-spring 52.

In this way, it is possible to release the upper pen-tube 2 and the pen-refill-unit 5 to expose the pen-cartridge 54 of the pen-refill unit 5 to allow the user to write.

When users finish writing, the push changes again from the working state to resting state. The process is summarized below.

Upon completion of writing, the user may perform the retraction operation to retract the refill of the writing implement as follows. Similarly, the top end of the upper pen-tube 2 may be pressed to cause the upper pen-tube 2 to move the retractable-core-rod 3 and the first-joint 211 conjunctively downward, thus making the slide-groove 32 of the retractable-core-rod 3 start to slide through the guide-block 421 of the plunger 42 to allow the first-joint 211 of the upper pen-tube 2 to push the plunger 42; at this moment, the flat rib 422 of the plunger 42 moves downward in the first-cam-groove 416 and second-cam-groove 417 of the stationary-cam-sleeve 41, causing the plunger 42 to push lower-toothed part 433 of the rotating cam 43 by using the slant structure of the upper-toothed part 423 on the end edge thereof to rotate the rotating cam 43, pushing the key-rib 434 of the rotating cam 43 to separate from the second-rib 413 and the second-rib-slant part 415 on the bottom end of the first-cam-groove 416, thus sliding and head hinging against the first-rib-slant 414 of the first-rib 412 and entering into the second-cam-groove 417 of the stationary-cam-sleeve 41, meanwhile, the cam-groove 435 of the rotating cam 43 moving onto the first-rib 412 and second-rib 413 of the stationary-cam-sleeve 41; while the rotating cam 43 rotates, it simultaneously causes the lug 31 of the retractable-core-rod 3 to slide in the channel 431 of the rotating cam 43, stopped at the end edge of the stop-block 432 of the rotating cam 43, allowing the lower pen-tube 1 to retract toward inside of the upper pen-tube 2 and compress the first-spring 44, and the lug 31 of the retractable-core-rod 3 also bring the rotating cam 43 to move upward, enabling the release of the second-spring 52, thereby retracting the writing end of the pen-cartridge 54 in the pen-refill-unit 5 into the pen-point 12, thus completing the limited retraction of the upper pen-tube 2 and the pen-refill-unit 5 to facilitate convenience and portability. Accordingly, the present invention can meet user's demands in a more advanced, practical and satisfactory fashion, which conforms to various requirements on patent application as disclosed herein for legal protection.

The invention claimed is:

1. A retractable pen with retraction-linking device for extending pen-body, comprising:

a lower pen tube, comprising a stop ring installed on one end thereof;

an upper pen tube unit, movably with the lower pen tube, comprising a joint;

a retractable core rod, comprising a joint on one end thereof for combining with the upper pen tube, at least one lug disposed on a peripheral edge thereof, and at least one slide groove formed on an external side thereof;

a jump key unit, comprising a stationary cam sleeve fixed inside the lower pen tube, a plunger, a rotating cam, a first spring disposed on the retractable core rod with both ends thereof respectively head hinged against the upper pen tube and the stationary cam sleeve, in which the plunger correspondingly moves with the joint of the upper pen tube unit, which is formed on a guide block sliding in the slide groove of the retractable core rod, wherein a plurality of flat ribs are disposed on the peripheral edge of one end of the plunger, a plurality of upper toothed parts are disposed on the peripheral edge of one end of the plunger, at least one stop block inside the rotating cam allowing the lug to move and stop, and a third spring disposed on one end of the lower pen tube with both ends thereof respectively head hinged against the rotating cam and the stop ring; and a pen refill unit, disposed in the retractable core rod and leaned against the rotating cam, and a second spring is disposed between the pen refill unit and the lower pen tube.

2. A retractable pen with retraction-linking device for extending pen-body as claimed in claim 1, wherein the third spring is disposed in the lower pen tube with both ends thereof respectively head hinged against the stop ring installed on one end of the lower pen tube and the stop edge is disposed on one end of the rotating cam, thereby keeping the rotating cam head hinged by the third spring, and thereby maintaining its correct linked motion position within the lower pen tube.

3. A retractable pen with retraction-linking device for extending pen-body as claimed in claim 1, wherein the upper pen-tube unit is optionally provided selected from a pen-clip, an upper pen-tube, a window, and a bushing ring.

4. A retractable pen with retraction-linking device for extending pen-body as claimed in claim 1, wherein the retractable core rod is movably disposed in the jump key unit to move simultaneously with the upper pen tube unit in conjunction with the jump key unit.

5. A retractable pen with retraction-linking device for extending pen-body as claimed in claim 1, wherein a stop edge is formed on one peripheral end of the stationary cam sleeve, and a plurality of ribs and grooves are formed on the inner edge of the stationary cam sleeve.

6. A retractable pen with retraction-linking device for extending pen-body as claimed in claim 1, wherein lower toothed part corresponding to the upper toothed part is disposed on the peripheral edge of the rotating cam, and a plurality of key ribs movable in the grooves is disposed on the peripheral edge of the plunger and head hinging against end edges of the ribs.

7. An retractable pen with retraction-linking device for extending pen-body as claimed in claim 1, wherein both sides of a ring pad of the pen refill unit respectively lean against the rotating cam and the spring.

* * * * *